US012498168B2

(12) United States Patent
Gluck Griswold et al.

(10) Patent No.: US 12,498,168 B2
(45) Date of Patent: Dec. 16, 2025

(54) FRONT LOADING CAN RACK SYSTEM FOR REFRIGERATION APPLIANCES

(71) Applicants: BSH Home Appliances Corporation, Irvine, CA (US); BSH Hausgeräte GmbH, Munich (DE)

(72) Inventors: Sarah Gluck Griswold, Powell, TN (US); Samuel Harward, Knoxville, TN (US); Elena Rajan, Maryville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 203 days.

(21) Appl. No.: 18/239,776

(22) Filed: Aug. 30, 2023

(65) Prior Publication Data

US 2025/0075968 A1 Mar. 6, 2025

(51) Int. Cl.

| | |
|---|---|
| ***F25D 23/04*** | (2006.01) |
| ***A47F 1/08*** | (2006.01) |
| ***F25D 25/00*** | (2006.01) |

(52) U.S. Cl.

CPC ..... *F25D 25/00* (2013.01); *A47F 1/08* (2013.01); *F25D 23/04* (2013.01); *F25D 2331/805* (2013.01); *F25D 2331/809* (2013.01)

(58) Field of Classification Search

CPC .... F25D 2331/805; F25D 25/00; F25D 23/04; F25D 31/007; F25D 23/02; F25D 23/028; F25D 2331/809; A47F 1/08; A47F 1/087; G07F 11/04

See application file for complete search history.

(56) References Cited

U.S. PATENT DOCUMENTS

| | | | | |
|---|---|---|---|---|
| 1,576,010 A | | 3/1926 | Swartz | |
| 1,614,017 A | * | 1/1927 | Nuhrah | F25D 31/007 62/374 |
| 1,714,469 A | * | 5/1929 | Hoffman | A47F 1/08 242/146 |
| 2,711,241 A | | 6/1955 | Abrahamsen | |

(Continued)

FOREIGN PATENT DOCUMENTS

| | | | |
|---|---|---|---|
| CN | 1464269 | A | 12/2003 |
| CN | 114593538 | A | 6/2022 |

(Continued)

*Primary Examiner* — Hiwot E Tefera

(74) *Attorney, Agent, or Firm* — Michael E. Tschupp; Andre Pallapies; Brandon G. Braun

(57) ABSTRACT

A front loading can rack system for a refrigeration appliance can be provided for receiving, storing, and dispensing canned items. The front loading can rack system can include a top cover, which can be coupled with at least two walls of the front loading can rack system. The front loading can rack system can also include compartments for storing cans. Additionally, the front loading can rack system can include a first set of front openings positioned directly below the top cover for receiving cans and a second set of front openings positioned at bottoms of the compartments for dispensing cans. Moreover, the front loading can rack system can include hook mechanisms, which can be positioned on one or more back walls of the compartments. The hook mechanisms can couple the front loading can rack system to the refrigeration appliance by attaching to bolts of the refrigeration appliance.

20 Claims, 14 Drawing Sheets

(56) References Cited

U.S. PATENT DOCUMENTS 2,728,623 A * 12/1955 Foerstner ..... F25D 23/04 211/49.1
2,826,471 A 3/1958 Fonda
3,018,001 A * 1/1962 Combs ..... A47F 1/08 221/242
3,220,558 A * 11/1965 Olsson ..... F25D 23/04 312/405.1
4,955,529 A * 9/1990 Barnhart ..... A47F 1/08 206/315.9
5,667,082 A * 9/1997 Hamilton ..... A47F 1/08 206/315.9
6,206,237 B1 * 3/2001 Dillon ..... B65G 1/08 221/312 R
6,694,771 B2 2/2004 Kim et al.
7,150,155 B2 12/2006 Faber
8,147,016 B2 4/2012 Kwon
9,907,437 B2 * 3/2018 Smith ..... A47J 47/16
10,610,342 B2 * 4/2020 Willes ..... A61C 13/082
10,919,702 B1 * 2/2021 Berta ..... B65G 11/04
2003/0046951 A1 * 3/2003 Kim ..... F25D 23/04 62/465
2005/0023939 A1 2/2005 Kramer et al.
2006/0152122 A1 * 7/2006 Garrett ..... F25D 23/04 312/405.1
2007/0157655 A1 * 7/2007 Eveland ..... A47F 1/087 62/407
2013/0133352 A1 * 5/2013 Park ..... F25D 23/126 62/340
2023/0280091 A1 * 9/2023 Bertolini ..... F25D 23/126 312/212

FOREIGN PATENT DOCUMENTS

GB 2190904 A * 12/1987 ..... A47F 1/08
KR 100402606 B1 10/2003
KR 20060002558 A 1/2006

* cited by examiner

FRONT LOADING CAN RACK SYSTEM FOR REFRIGERATION APPLIANCES

TECHNICAL FIELD

The present disclosure relates generally to refrigeration appliances and, more particularly (although not necessarily exclusively), to a front loading can rack system for refrigeration appliances.

BACKGROUND

Household appliances such as refrigerators can include shelves and drawers for storing items. The house appliances can also include specific compartments such as can racks. The can racks can be used to store canned drinks, canned foods, or the like to improve organization within the household appliance and to improve accessibility with respect to canned items. The can racks may be positioned in the refrigeration appliance and may take up significant space. Therefore, it may be desirable to design a can rack that can fit seamlessly around or near other features of a household appliance. Additionally, users may misuse can racks. For example, users may dispose of or position cans incorrectly within a can rack or may use the can rack to store non-canned items. Misuse of a can rack may cause damage to the non-canned items, cans, or to the can rack itself. Moreover, during production of refrigerators, ease of assembly of compartments such as can racks can lead to more refrigerators being produced in a shorter amount of time. In addition, if maintenance or other services involve disassembling a can rack, it may be advantageous for the can rack, to be removable from the refrigeration appliance using minimal tools.

DETAILED DESCRIPTION

Figure 1:
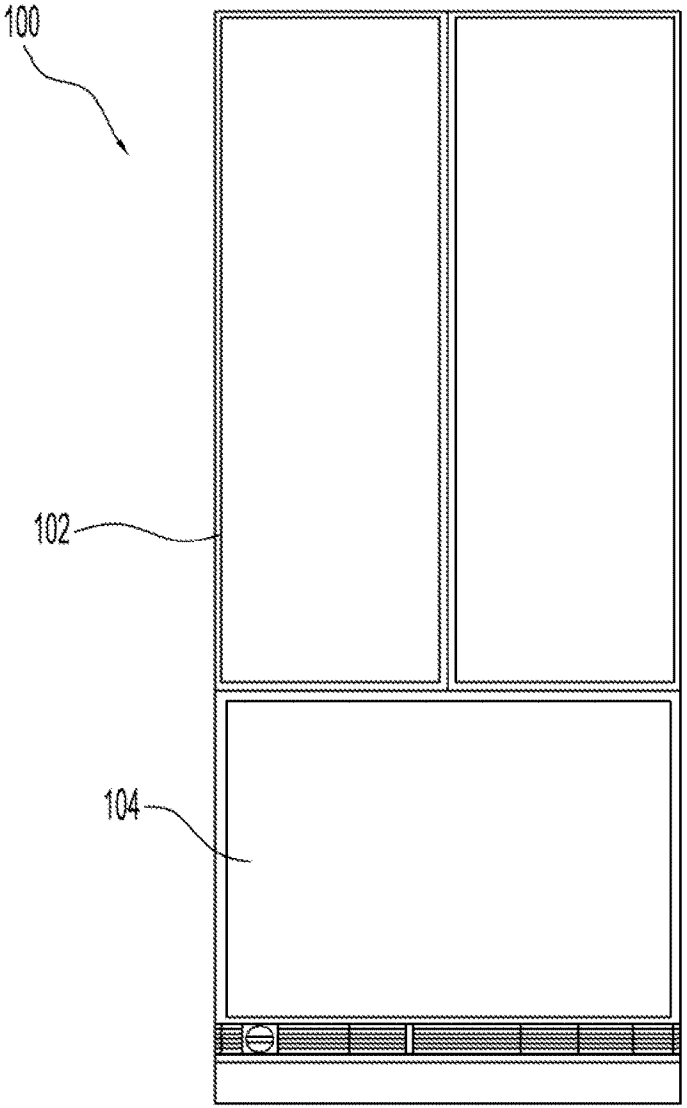
FIG. 1 depicts an example of a refrigeration appliance according to some embodiments of the present disclosure.

Certain aspects and examples of the present disclosure relate to a front loading can rack system for storing and dispensing cans or other suitable objects of similar shape or size. More specifically, aspects and examples of the present disclosure are directed to a front loading can rack system with a top cover for preventing users from incorrectly inserting cans into the front loading can rack system.

The front loading can rack system can include a first front opening though which a user can insert cans into the front loading can rack system. The first front opening can be positioned and sized to promote correct insertion of cans in the front loading can rack system. For example, the first front opening can be rectangular with a width that is greater than a height to promote horizontal insertion of cans. In this way, cans cannot be inserted incorrectly (e.g., vertically) into the front loading can rack system and non-canned objects or objects that are too large for the front loading can rack system cannot be inserted into the front loading can rack system, thereby minimizing a risk of damage to the front loading can rack system. By promoting correct insertion of the cans, the first front opening can further minimize a risk of cans or other suitable objects falling out of the front loading can rack system.

The front loading can rack system can also include a second front opening through which cans can be dispensed. For example, the first front opening can be on a top portion of the front loading can rack system and a second front opening can be on a bottom portion of the front loading can rack system. Thus, a can may be inserted via the first front opening. After insertion, the can may fall through a compartment of the front loading can rack system to a bottom of the front loading can rack. A user may then retrieve the can from the front loading can rack system via the second front opening.

Additionally, the front loading can rack can include front flaps for retaining cans within the compartment of the front loading can rack system. In some examples, the front loading can rack can have two front flaps with a gap in-between. The gap can provide a space through which a user may adjust cans positioned in the front loading can rack. For example, a user may reach through the gap to straighten a can that is not positioned horizontally within the compartment of the front loading can rack system. Similarly, the front loading can rack system can include bottom flaps for retaining cans at the bottom of the front loading can rack system before. The front loading can rack system may also have two bottom flaps with a gap in-between. The user may reach through the gap between the bottom flaps to lift cans out of the second front opening.

In some examples, the front loading can rack system can be positioned in a refrigeration appliance. For example, the front loading can rack system can be positioned on an inner side of a door of the refrigeration appliance. The front loading can rack system may be configured to fit seamlessly around or near other features of the refrigeration appliance such as shelves, ice makers, or other suitable features. In a particular example, the front loading can rack system may be positioned at least partially behind and underneath an ice maker on the door of the refrigeration appliance. Thus, the front loading can rack system may include a top cut out and a back cut out to enable a seamless fit of the front loading can rack system the ice maker. In this way, the front loading can rack system can be seamlessly integrated within the refrigeration appliance to minimize a volume of the refrigeration appliance taken up by the front loading can rack system. Consequently, a usable volume within the refrigeration appliance is maximized.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 depicts an example of a refrigeration appliance 100 according to some embodiments of the present disclosure. The refrigeration appliance 100 can be a refrigerator, a freezer, or a combination thereof. For example, the refrigeration appliance 100 can include a first cabinet 102 defining a refrigeration space and a second cabinet 104 defining a freezer space. The first cabinet 102 and the second cabinet 104 may be arranged in various orientations, such as the first cabinet 102 positioned above the second cabinet 104 as depicted in FIG. 1. In another example, the first cabinet 102 may be positioned side by side or below the second cabinet 104, or in any other suitable arrangement. The first cabinet 102 or the second cabinet 104 may include a can rack, such as the front loading can rack system 200 depicted in FIG. 2. The first cabinet 102 or the second cabinet 104 may further include an ice maker. For example, the ice maker can be positioned on an inner side of a door of the first cabinet 102 and the can rack can be coupled to the ice maker.

Figure 2:
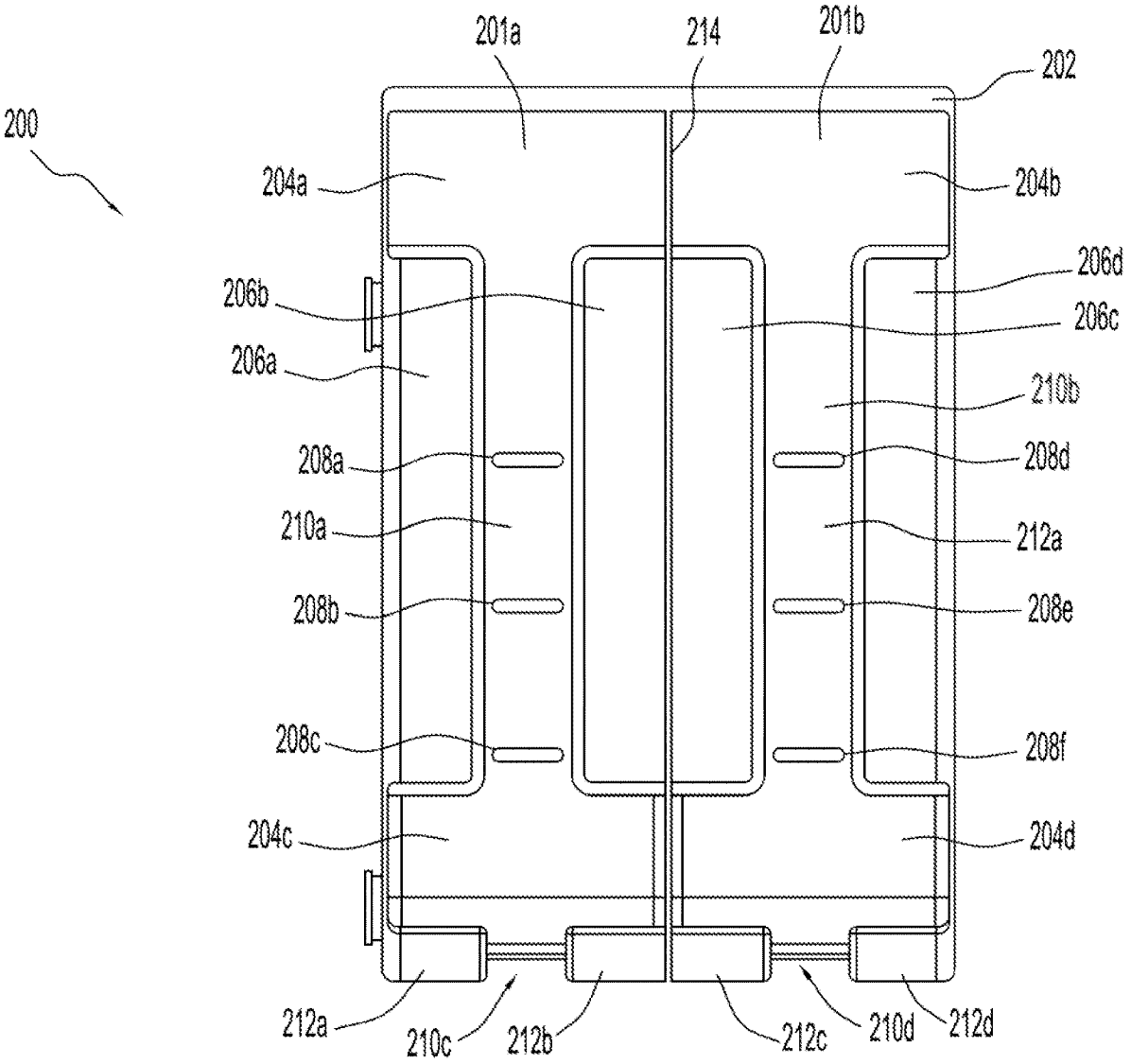
FIG. 2 depicts a front view of a front loading can rack system according to some embodiments of the present disclosure.

FIG. 2 depicts a front view of a front loading can rack system 200 according to some embodiments of the present disclosure. The front loading can rack system 200 can be positioned in a refrigeration appliance, such as the refrigeration appliance 100 depicted in FIG. 1. For example, the front loading can rack system 200 can be positioned at least partially behind an ice maker on a door of the refrigeration appliance 100. The front loading can rack system 200 can include a top cover 202, which can prevent users from dropping cans into the rack from above. The top cover 202 can be coupled with at least two walls of the front loading can rack system 200 to provide structural support to the walls. Additionally, in some examples, the top cover 202 may be used as a shelf within the refrigeration appliance.

The front loading can rack system 200 can further include front openings 204*a-d*. A first set of front openings can include a first front opening 204*a* and a second front opening 204*b*. The first set of front openings 204*a-b* can be positioned at a top of the front loading can rack system 200 directly below the top cover 202. The first set of front openings 204*a-b* can be used for inserting cans into the front loading can rack system 200. For example, a user may insert a can via the first front opening 204*a* into a first compartment 201*a* of the front loading can rack system 200. Additionally, a second set of front openings can include a third front opening 204*c* and a fourth front opening 204*d*. The second set of front openings 204*c-d* can be positioned on a bottom of the front loading can rack system 200. The second set of front openings 204*c-d* can be used to retrieve cans from the front loading can rack system 200. For example, the can inserted into the first compartment 201*a* can fall to the bottom of the front loading can rack system 200. The can may be stored at the bottom for a period of time. Then, the user may retrieve the can via the third front opening 204*c*.

Additionally, front flaps 206*a-d* can be positioned on a front side of the front loading can rack system 200 to maintain cans within compartments 201*a-b*. For example, the front flaps 206*a-d* may prevent cans from falling out of a front side of the front loading can rack system 200. A first front flap 206*a* and a second front flap 206*b* can be associated with the first compartment 201*a*. A third front flap 206*c* and a fourth front flap 206*d* can be associated with a second compartment 201*b*. In an example, the compartments 201*a-b* may each hold up to six cans. Alternatively, the compartments 201*a-b* may hold a different number of cans (e.g., four, eight, or twelve cans). In some examples, a center wall 214 can separate the compartments 201*a-b*. In other examples, the front loading can rack system 200 may consist of a different number of compartments, or the compartments may not be separated by a wall. Additionally, there can be a first gap 210*a* between the first front flap 206*a* and the second front flap 206*b*. There can also be a second gap 210*b* between the third front flap 206*c* and the fourth front flap 206*d*. The gaps 210*a-b* can provide a space through which the user may adjust cans positioned in the front loading can rack system 200. For example, the user may turn a can that is not positioned horizontally within the front loading can rack system 200.

Similarly, bottom flaps 212*a-d* can further maintain cans within the compartments 201*a-b* by preventing cans from falling out of a bottom side of the front loading can rack system 200. As depicted, a first bottom flap 212*a* and a second bottom flap 212*b* can be associated with the first compartment 201*a*, and a third bottom flap 212*c* and a fourth bottom flap 212*d* can be associated with the second compartment 201*b*. There can be a third gap 210*c* between the first bottom flap 212*a* and the second bottom flap 212*b*. There can also be a fourth gap 210*d* between the third front flap 206*c* and the fourth front flap 206*d*. The gaps 210*c-d* can provide a space through which the user may interact with cans. For example, a user may use the third gap 210*c* to lift a can out of third front opening 204*c*.

The front loading can rack system 200 can also include slots 208*a-f* through which back bumpers can be inserted. The back bumpers can be removable from the front loading can rack system 200. The back bumpers can slow cans inserted into the compartments 201*a-b* as the cans fall to the bottom of the front loading can rack system 200 or on to another can. For example, the back bumpers can each have a flexible flap that can be in a first position. The first position can be parallel to a bottom wall of the can rack. The flexible flaps may flex downward due to a weight of a can contacting the back bumpers as the can falls through one of the compartments 201*a-b*. Then, the back bumpers can flex upward to return to the first position. In this way, the back bumpers can repeatedly slow cans to minimize damage to the cans, the front loading can rack system 200, or a combination thereof associated with an impact of cans inserted into the compartments 201*a-b*.

Figure 3:
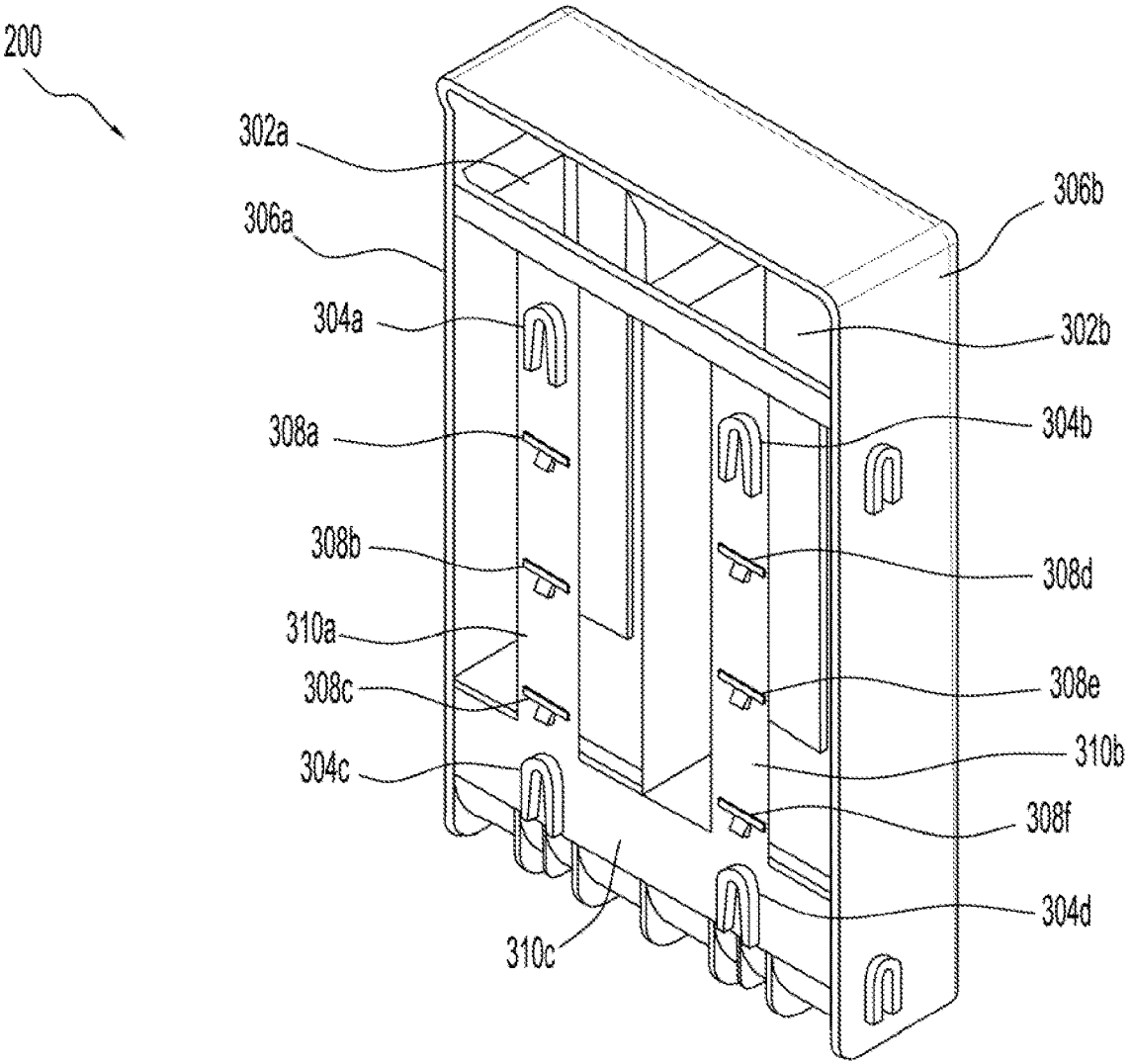
FIG. 3 depicts a back view of a front loading can rack system according to some embodiments of the present disclosure.

FIG. 3 depicts a back view of a front loading can rack system 200 according to some embodiments of the present disclosure. The front loading can rack system 200 can be positioned in a refrigeration appliance, such as the refrigeration appliance 100 depicted in FIG. 1. To position the front loading can rack system 200 within the refrigeration appliance 100, the front loading can rack system 200 can include back cutouts 302*a-b*. For example, the front loading can rack system 200 can be positioned at least partially behind an ice maker on a door of the refrigeration appliance 100. Thus, the back cutouts 302*a-b* can be sized and positioned to fit around the ice maker. In other examples, the front loading can rack system 200 can be below the ice maker or otherwise positioned on the door of the refrigeration appliance. Thus, the back cutouts 302*a-b* can also be sized and positioned fit around other features of the refrigeration appliance such as shelves. In this way, the front loading can rack system 200 can be seamlessly integrated within the refrigeration appliance to maximize usable volume within the refrigeration appliance.

Additionally, the front loading can rack system 200 can include hook mechanisms 304*a-d*. The hook mechanisms 304*a-d* can be positioned on back walls 310*a-c*. The hook mechanisms 304*a-d* can hook onto bolts of the refrigeration appliance to hold the front loading can rack system 200 in place. For example, the ice maker can include bolts onto which the hook mechanisms 304*a-d* can be attached. The hook mechanisms 304*a-d* can each include a lower portion that is wider than an upper portion to facilitate easy installation of the front loading can rack system 200. Then, the upper portion can be sized to fit securely around at least a portion of the bolts.

The front loading can rack system 200 can further include back bumpers 308*a-f*. The back bumpers 308*a-f* can have flanges that fit through slots positioned on back walls 310*a-b* of the front loading can rack system 200. The back bumpers 308*a-f* can also have flexible flaps for slowing cans that are inserted into the front loading can rack system 200 to decrease an impact of the cans with a bottom of the front loading can rack system 200 or with other cans. Additionally, when the flanges are inserted through the slots, the back bumpers 308*a-f* can hook on the front loading can rack system 200. To do so, the back bumpers 308*a-f* can include a second flap from which the flanges can protrude. The second flap can be perpendicular to the flexible flap. The second flap and the flange can hook on to the back walls 310*a-d* such that the second flap is in contact with an inner side of one of the back walls 310*a-d* and the flange is in contact with an outer side of one of the back walls 310*a-d*.

Figure 4:
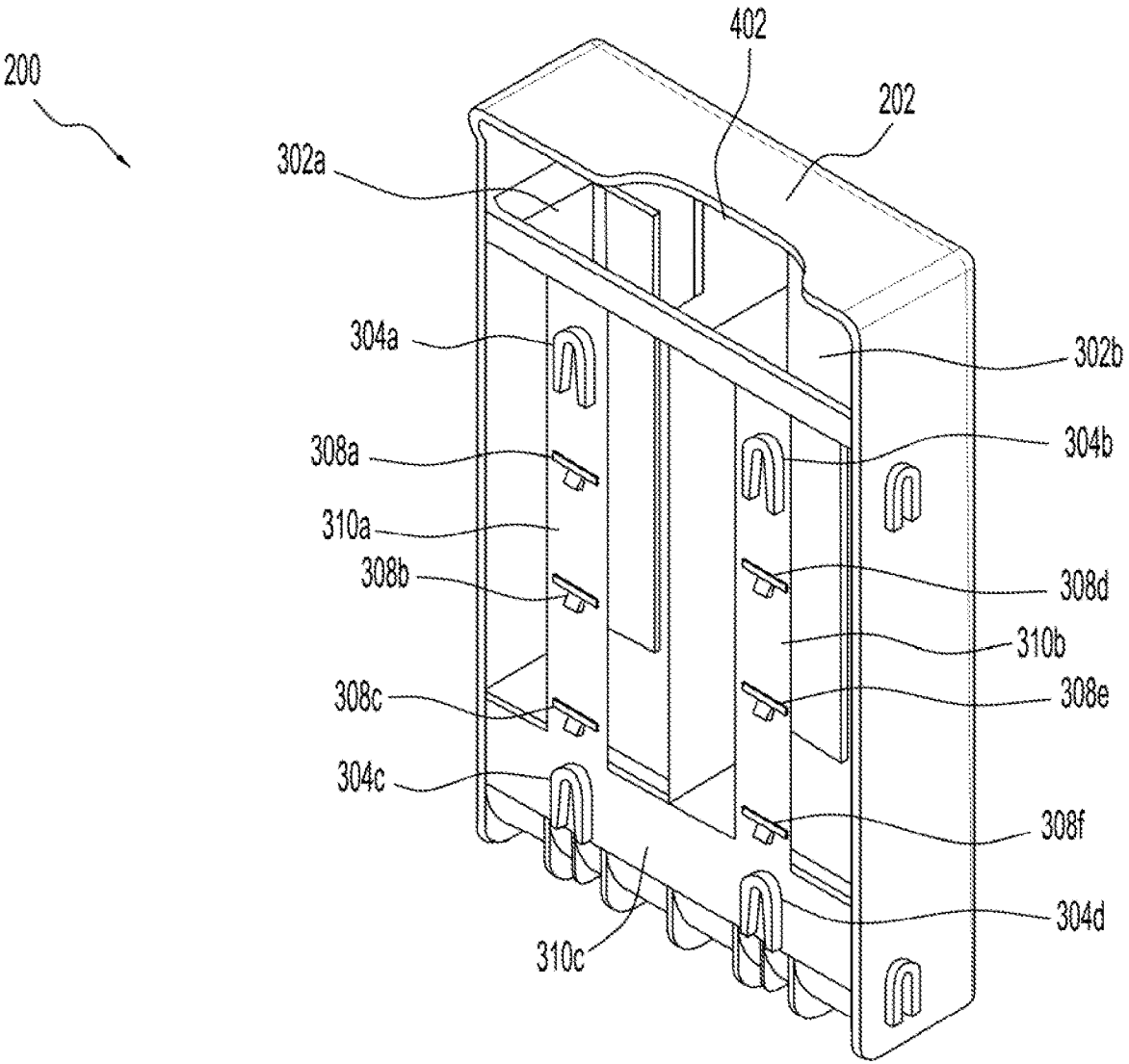
FIG. 4 depicts another back view of a front loading can rack system according to some embodiments of the present disclosure.

FIG. 4 depicts another back view of a front loading can rack system 200 according to some embodiments of the present disclosure. The front loading can rack system 200 can be positioned in a refrigeration appliance. To position the front loading can rack system 200 within the refrigeration appliance 100, the front loading can rack system 200 can include back cutouts 302*a-b*. The front loading can rack system can further include a top cutout 402. In some examples, the front loading can rack system 200 can be positioned at least partially behind an ice maker on a door of the refrigeration appliance 100. Thus, the top cutout 402 and back cutouts 302*a-b* can be sized and positioned to enable the front loading can rack system 200 to fit seamlessly around the ice maker.

The front loading can rack system 200 can further include hook mechanisms 304*a-d* positioned on back walls 310*a-c*. As depicted, a first hook mechanism 304*a* can be positioned on a first back wall 310*a*, a second hook mechanism 304*b* can be positioned on a second back wall 310, and a third hook mechanism 304*c* and a fourth hook mechanism 304*d* can be positioned on a third back wall 310*c*. The positioning of the hook mechanisms 304*a-d* can correspond to bolts on the refrigeration appliance. Thus, the hook mechanisms 304*a-d* can be secured around the bolts to install the front loading can rack system 200 in the refrigeration appliance.

The front loading can rack system 200 can also include a top cover 202, which can prevent users from dropping cans into the rack from above and can provide structural support to walls of the front loading can rack system 200 that are connected to the top cover 202. In some examples, the front loading can rack system 200 can also include back bumpers 308*a-f*. The back bumpers 308*a-f* can slow cans that are inserted into the front loading can rack system 200.

Figure 5:
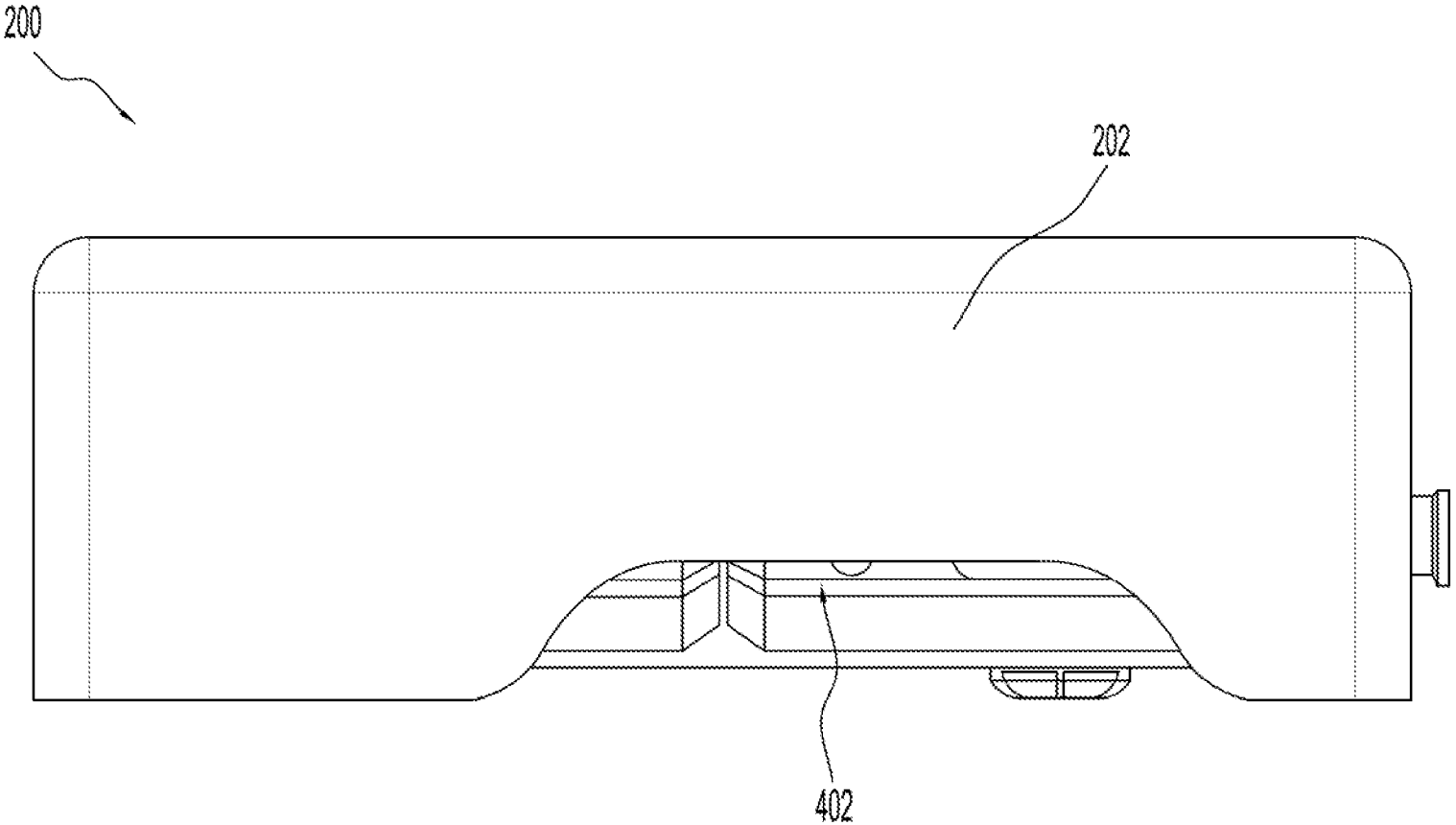
FIG. 5 depicts top view of a front loading can rack system according to some embodiments of the present disclosure.

FIG. 5 depicts top view of a front loading can rack system 200 according to some embodiments of the present disclosure. The front loading can rack system can include a top cutout 402 within a top cover 202 of the front loading can rack system 200. The top cutout 402 can be used to position the front loading can rack system 200 seamlessly around components of the refrigeration appliance. For example, the front loading can rack system 200 can be positioned at least partially behind an ice maker. Thus, the ice maker may be partially disposed within the top cutout 402. The use of the top cutout 402 to fit around the ice maker or other suitable components of the door can maximize usable space within the refrigeration appliance.

Figure 6:
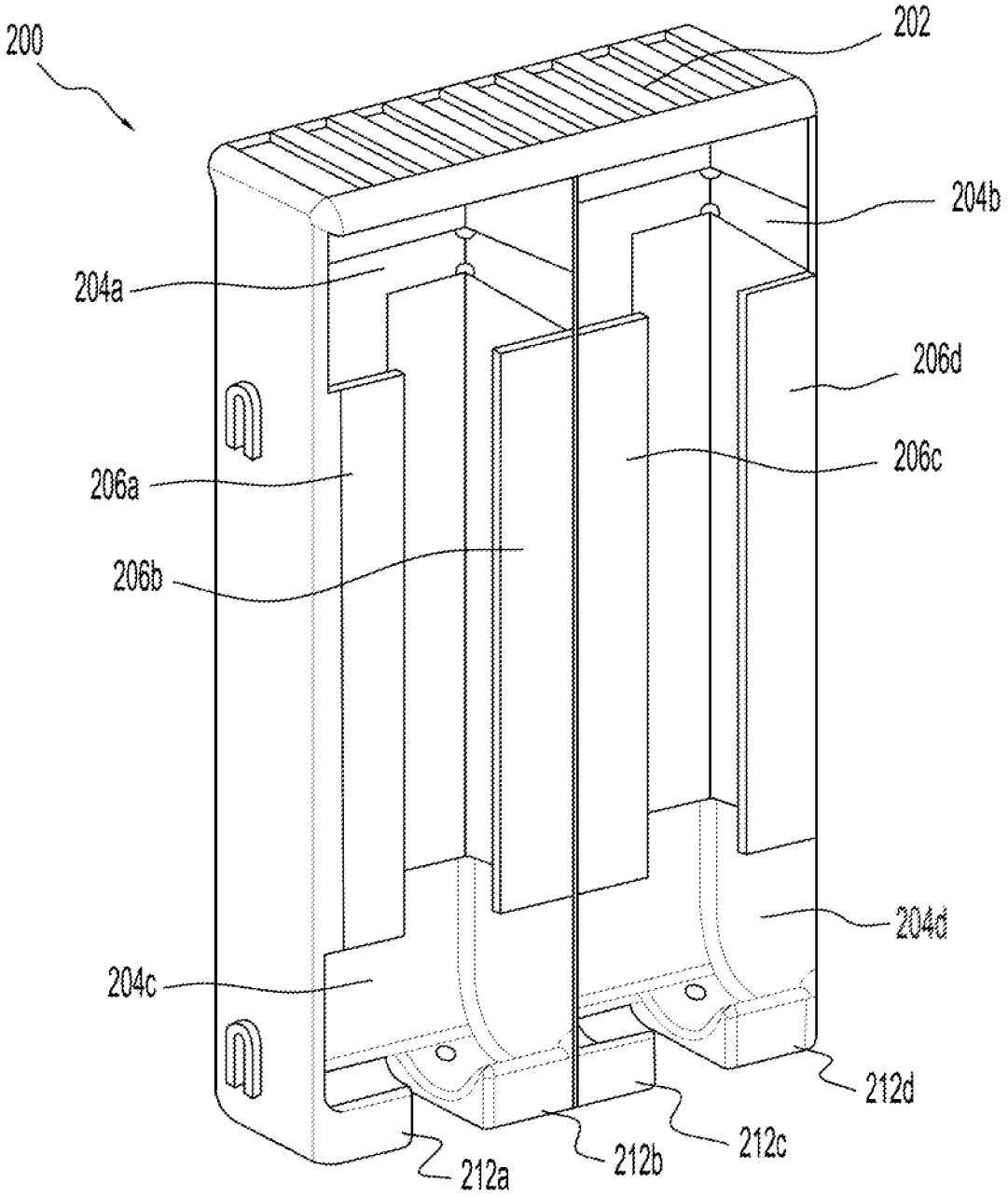
FIG. 6 depicts another front view of a front loading can rack system according to some embodiments of the present disclosure.

FIG. 6 depicts another front view of a front loading can rack system 200 according to some embodiments of the present disclosure. The front loading can rack system 200 can include a top cover 202, which can prevent users from dropping cans into the rack from above. As depicted, the top cover 202 can have a textured surface. In some examples, the textured surface may be used to promote use of the top cover 202 a shelf within the refrigeration appliance. In other examples, the texture surface may prevent users from using the top cover 202 as a shelf.

The front loading can rack system 200 can further include front openings 204*a-d*. A first front opening 204*a* and a second front opening 204*b* can be used for inserting cans into the front loading can rack system 200. A third front opening 204*c* and a fourth front opening 204*d* can be used to dispense cans from the front loading can rack system 200. The front loading can rack system 200 can further include front flaps 206*a-d* to prevent cans from falling out of a front side of the front loading can rack system 200. Similarly, bottom flaps 212*a-d* can hold cans within a bottom portion of the front loading can rack system 200.

Figure 7:
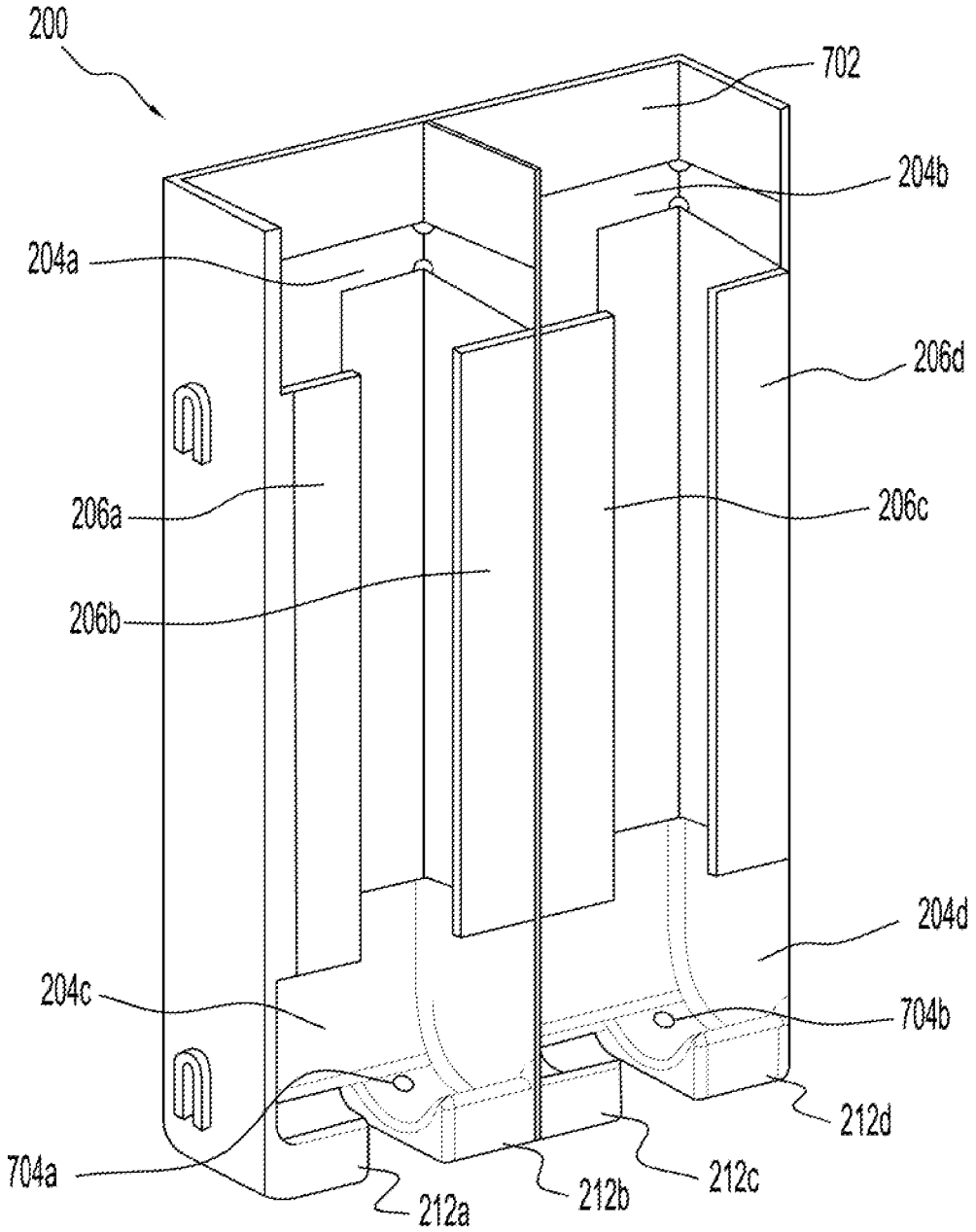
FIG. 7 depicts another front view of a front loading can rack system according to some embodiments of the present disclosure.

FIG. 7 depicts another front view of a front loading can rack system 200 according to some embodiments of the present disclosure. The front loading can rack system 200 can include a top opening 702, which may enable users to remove cans from the front loading can rack system 200. The front loading can rack system 200 can further include front openings 204*a-d*. As depicted, the top opening 702 can lead directly into a first front openings 204*a* and a second front opening 204*b*.

Additionally, front flaps 206*a-d* can be positioned on a front side of the front loading can rack system 200 for maintaining cans within the front loading can rack system 200. Similarly, bottom flaps 212*a-d* can be positioned on a bottom side of the front loading can rack system 200. The bottom flaps 212*a-d* can further maintain cans within the front loading can rack system 200.

In some examples, a first bottom dampener 704*a* can be positioned in a second bottom flap 212*b* and a second bottom dampener 704*b* can be positioned in a fourth bottom flap 212*d*. A first bottom flap 212*a* and a third bottom flap 212*c* may also include bottom dampeners. The bottom dampeners 704*a-b* can have tabs that fit through holes in the second bottom flap 212*b* and the fourth bottom flap 212*d*. As a result, the bottom dampeners 704*a-b* can be removably coupled to the front loading can rack system 200. The bottom dampeners 704*a-b* can at least partially absorb an impact of a can as the can falls onto the bottom flaps 212*a-d*. Thus, the bottom dampeners 704*a-b* can prevent damage to the falling can or to the front loading can rack system 200. The bottom dampeners 704*a-b* can further reduce noise associated with the falling can encountering the bottom flaps 212*a-d*.

Figure 8:
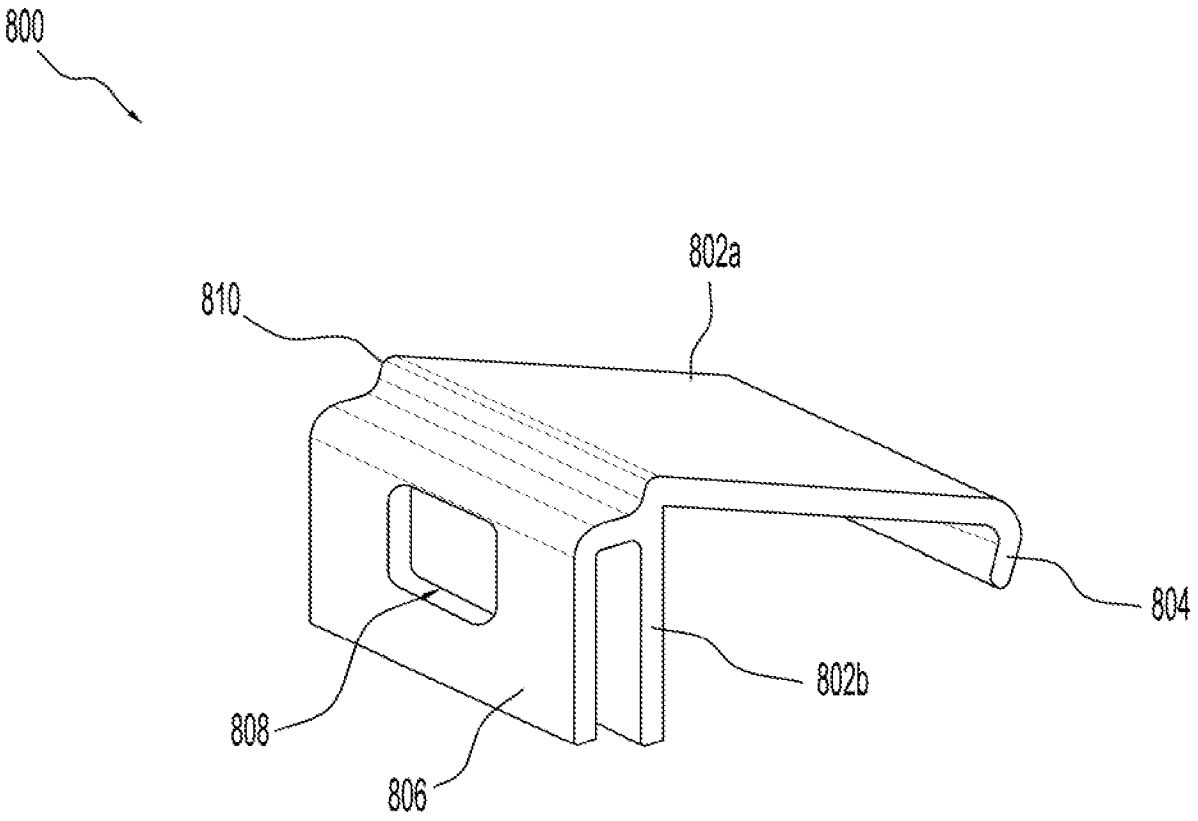
FIG. 8 depicts an example of a back bumper for a front loading can rack system according to some embodiments of the present disclosure.

FIG. 8 depicts an example of a back bumper 800 for a front loading can rack system according to some embodiments of the present disclosure. The back bumper 800 depicted can correspond to the first back bumper 308*a* depicted in FIG. 3. The back bumper 800 can be removably coupled to a can rack system, such as the front loading can rack system 200 depicted in FIG. 2.

The back bumper 800 can include a first flap 802*a*, which can repeatedly flex as cans are inserted into the front loading can rack system 200. For example, the first flap 802*a* can be in a first position, as depicted. Then, the first flap 802*a* can flex downward while in contact with a can falling through a compartment of the front loading can rack system 200. Once the can is below the first flap 802*a*, the first flap 802*a* can return to the first position. The first flap 802*a* can retain its size, shape, and impact resistance while repeatedly flexing downward and returning to the first position as cans are inserted and removed from the front loading can rack system 200. In some examples, the first flap 802*a* can include a hooked portion 804. The hooked portion 804 can prevent items below the first flap 802*a* from directly pushing up on the first flap 802*a*. Thus, the hooked portion 804 can protect a structural integrity of the first flap 802*a* and can prevent cans from being pushed out of a top of the front loading can rack system 200.

The back bumper 800 can also include a second flap 802*b*. A raised step 810 can be between the first flap 802*a* and the second flap 802*b* to enable the first flap 802*a* to move independently of the second flap 802*b*. In some examples, the first flap 802*a* and the second flap 802*b* can be made of the same material, such as a rubber material. Alternatively, the second flap 802*b* can be made of a different material than the first flap 802*a*. For example, the second flap 802*b* can be made of a first material that has a greater stiffness than a second material of the first flap 802*a*.

Additionally, a flange 806 can protrude from the second flap 802*b* for coupling the back bumper 800 with the front loading can rack system 200. The flange 806 can include a flange hole 808 which can further secure the connection between the front loading can rack system 200 and the back bumper 800. The flange hole 808 can also provide visibility to facilitate easy installation of the back bumper 800 on to the front loading can rack system 200. Additionally, after installation, the flange hole 808 can enable a user to see that the back bumper 800 has been installed correctly. In this way, the flange hole 808 can ensure intended use of the back bumper 800 and can reduce a risk of damaging the back bumper 800 or the front loading can rack system 200 during installation.

Moreover, because back bumpers can be removably attached to the front loading can rack system 200 rather than being additional features of a main body of the front loading can rack system 200, back bumpers can be a cost-effective solution for slowing cans in the front loading can rack system 200. The removability of the back bumpers can also allow for different back bumper designs to be employed within the front loading can rack system. Thus, the back bumpers can be interchangeable depending on the size of the cans being put into the can rack. For example, back bumpers with a longer first flap can be used for food cans, which may be heavier than beverage cans. The removability of the back bumpers further enables easy cleaning and replacement.

Figure 9:
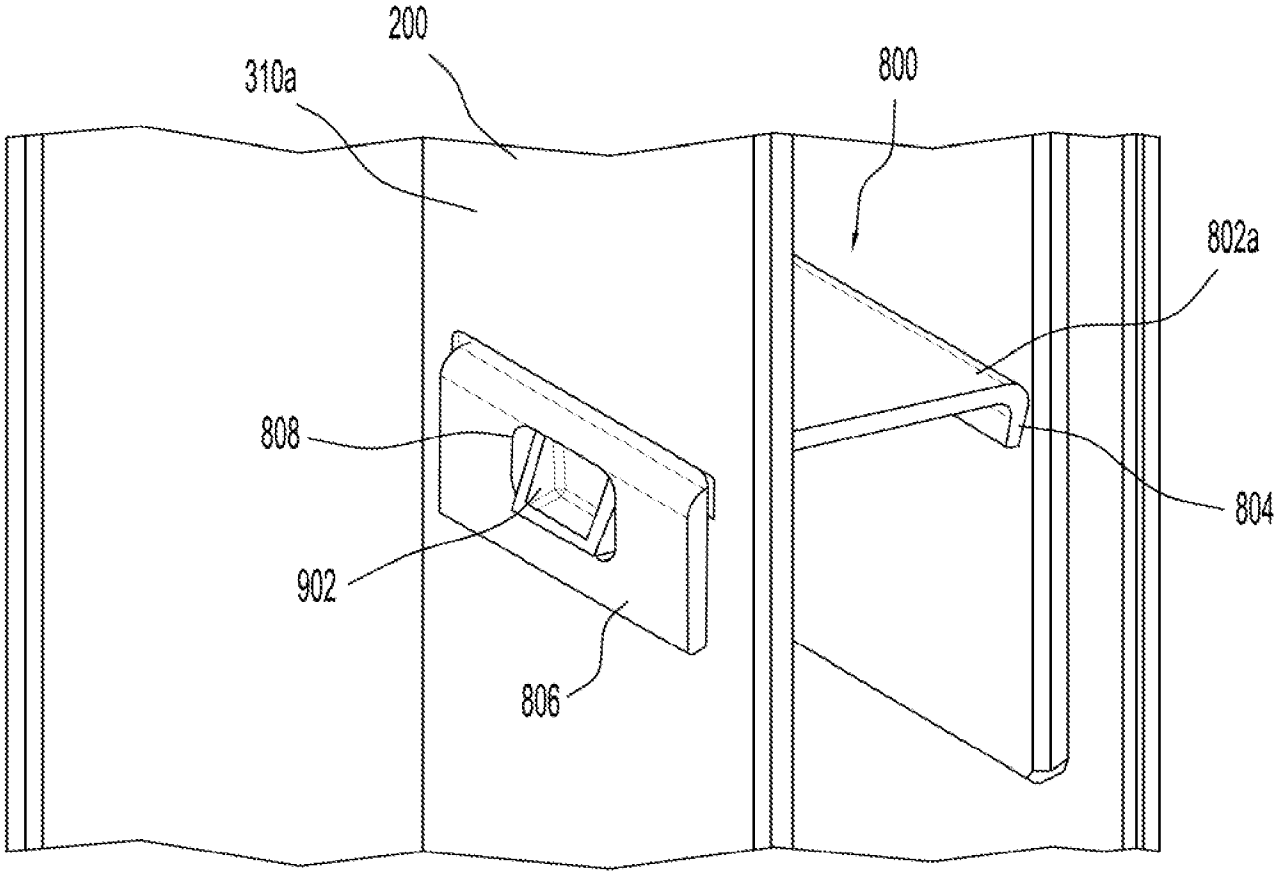
FIG. 9 depicts an example of a back bumper coupled with a front loading can rack system 200 according to some embodiments of the present disclosure.

FIG. 9 depicts an example of a back bumper 800 coupled with a front loading can rack system 200 according to some embodiments of the present disclosure. The back bumper 800 depicted can correspond to the first back bumper 308*a* depicted in FIG. 3. The back bumper 800 can be removably coupled to the front loading can rack system 200. For example, the back bumper 800 can include a flange 806, which can be inserted through a slot of the front loading can rack system 200. In doing so, a first flap 802*a* can be disposed within a compartment, such as a first compartment 201*a* of the front loading can rack system 200. Additionally, the back bumper 800 can be hooked onto a first back wall 310*a* of the front loading can rack system 200. As a result, a second flap of the back bumper 800 can be in contact with an inner side of the first back wall 310*a* and the flange 806 of the back bumper 800 can be in contact with an outer side of the first back wall 310*a*. Then, a protruding portion 902 of the first back wall 310*a* can be coupled with the flange 806 via a flange hole 808 to further secure the attachment of the back bumper 800 to the front loading can rack system 200.

The back bumper 800 can also be easily detached from the front loading can rack system 200. For example, detaching the back bumper from the front loading can rack system 200 can include detaching the protruding portion 902 from flange 806, unhooking the flange 806 and the second flap 802*b* from the first back wall 310*a*, and sliding the flange 806 out of the slot.

Figure 10:
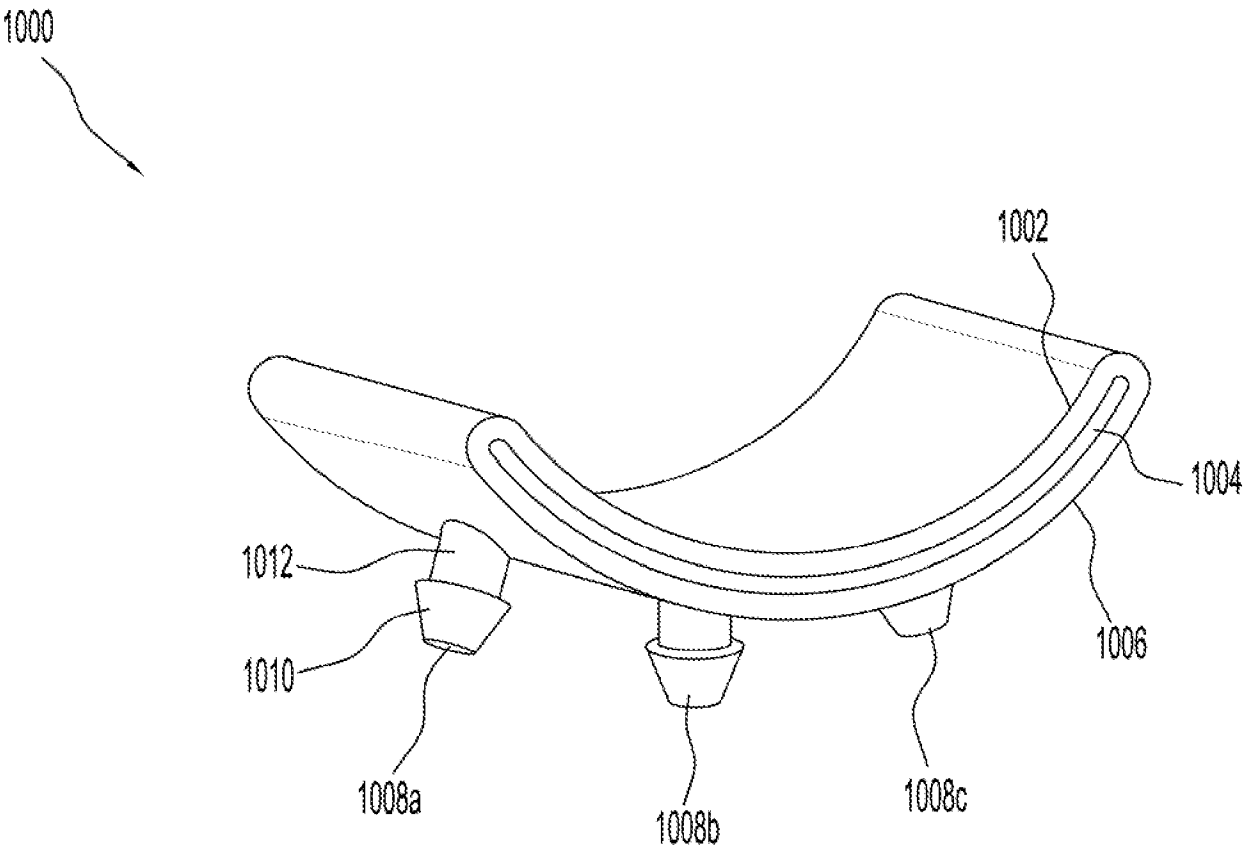
FIG. 10 depicts an example of a bottom dampener for a front loading can rack system according to some embodiments of the present disclosure.

FIG. 10 depicts an example of a bottom dampener 1000 for a front loading can rack system according to some embodiments of the present disclosure. The bottom dampener 1000 can correspond to the first bottom dampener 704*a* depicted in FIG. 7. The bottom dampener 1000 can be removably coupled to a can rack system, such as the front loading can rack system 200 depicted in FIG. 2.

The bottom dampener 1000 can include a top layer 1002 and a bottom layer 1006 with a hollow space 1004 between the layers. Due to a first thickness of the top layer 1002 and a second thickness of the bottom layer 1006, the bottom dampener 1000 can dampen an impact of a can on a bottom of the front loading can rack system 200. Additionally, by dampening the impact of the can, the bottom dampener 1000 can prevent a can from bouncing out of the bottom of the front loading can rack system 200. Thus, the first and second thickness can be sufficient for dampening the impact while minimizing an additional height of a stack of cans in the front loading can rack system 200 imposed by the bottom dampener 1000. In this way, the impact can be absorbed without wasting space within compartments of the front loading can rack system 200. The hollow space 1004 between the top layer 1002 and the bottom layer 1006 can further enhancing the dampening of the impact by the bottom dampener 1000. A width of the hollow space 1004 can also be sufficiently large for dampening the impact while also minimizing the additional height of the stack of cans in the front loading can rack system 200 imposed by the bottom dampener 1000.

The bottom dampener 1000 can further include tabs 1008*a-c* for coupling the bottom dampener 1000 to a bottom flap of the front loading can rack system. For example, the bottom flap can include holes through with the tabs 1008*a-c* can be inserted. The tabs 1008*a-c* may include a tab neck 1012 and a tab end 1010. The tab end 1010 can be wider than the tab neck 1012 to maintain a position of the tabs 1008*a-c* within the holes of the bottom flap.

Additionally, because bottom dampeners can be removed from the front loading can rack system 200 rather than being an additional feature of a main body of the front loading can rack system 200, bottom dampeners can be a cost-effective solution for absorbing an impact of cans at a bottom of the front loading can rack system 200. The removability can also enable easy cleaning and replacement. Additionally, because the bottom dampeners are a separate component, the bottom dampeners can be made of a different material than the main body of the front loading can rack system. In this way, a desirable material, such as a rubber material, for dampening the impact of cans and a sound of the cans at impact can be used for the bottom dampeners.

Figure 11:
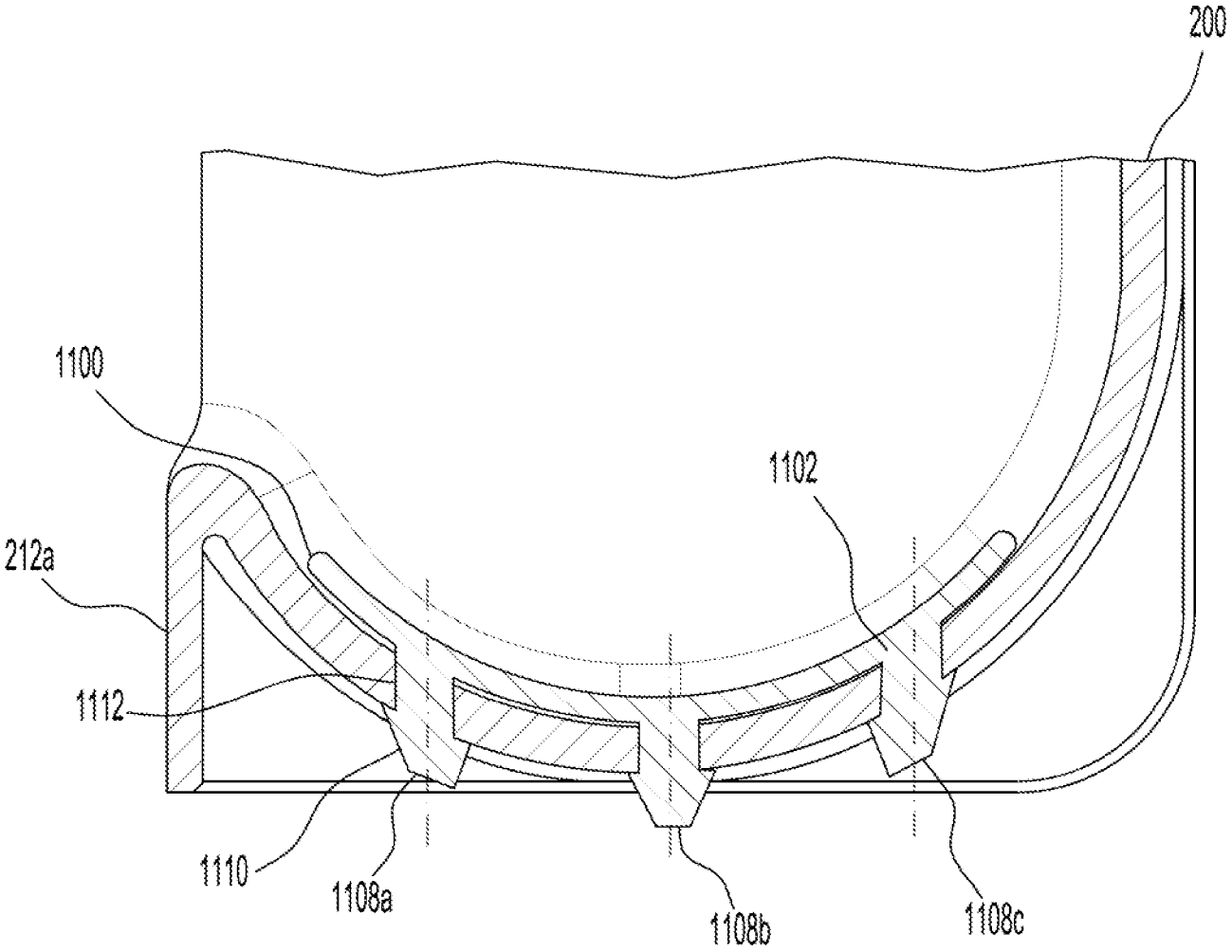
FIG. 11 depicts a cross sectional view of a bottom dampener coupled with a front loading can rack system 200 according to some embodiments of the present disclosure.

FIG. 11 depicts a cross sectional view of a bottom dampener 1100 coupled with a front loading can rack system 200 according to some embodiments of the present disclosure. The bottom dampener 1100 can correspond to the first bottom dampener 704*a* depicted in FIG. 7. The bottom dampener 1100 can include a layer 1102 with a thickness of sufficient for dampening an impact of a can as the can contacts the bottom dampener 1100 after falling through a compartment of the front loading can rack system 200. By dampening the impact of the can, the bottom dampener 1100 can prevent the can from bouncing out of the bottom of the front loading can rack system 200. Thus, the thickness of the layer 1102 can be sufficient for dampening the impact while minimizing an additional height of a stack of cans in the front loading can rack system 200 imposed by the bottom dampener 1100.

Additionally, the bottom dampener 1100 can be removably coupled to a first bottom flap 212*a* of the front loading can rack system 200. For example, the bottom dampener 1100 can include tabs 1108*a-c*, and the first bottom flap 212*a* can include holes through which the tabs 1008*a-c* can be inserted. The tabs 1008*a-c* may include a tab neck 1112 and a tab end 1110. As depicted, the tab end 1010 can be wider than the tab neck 1012 to maintain a position of the tabs 1108*a-c* within the holes of the first bottom flap 212*a*.

Figure 12:
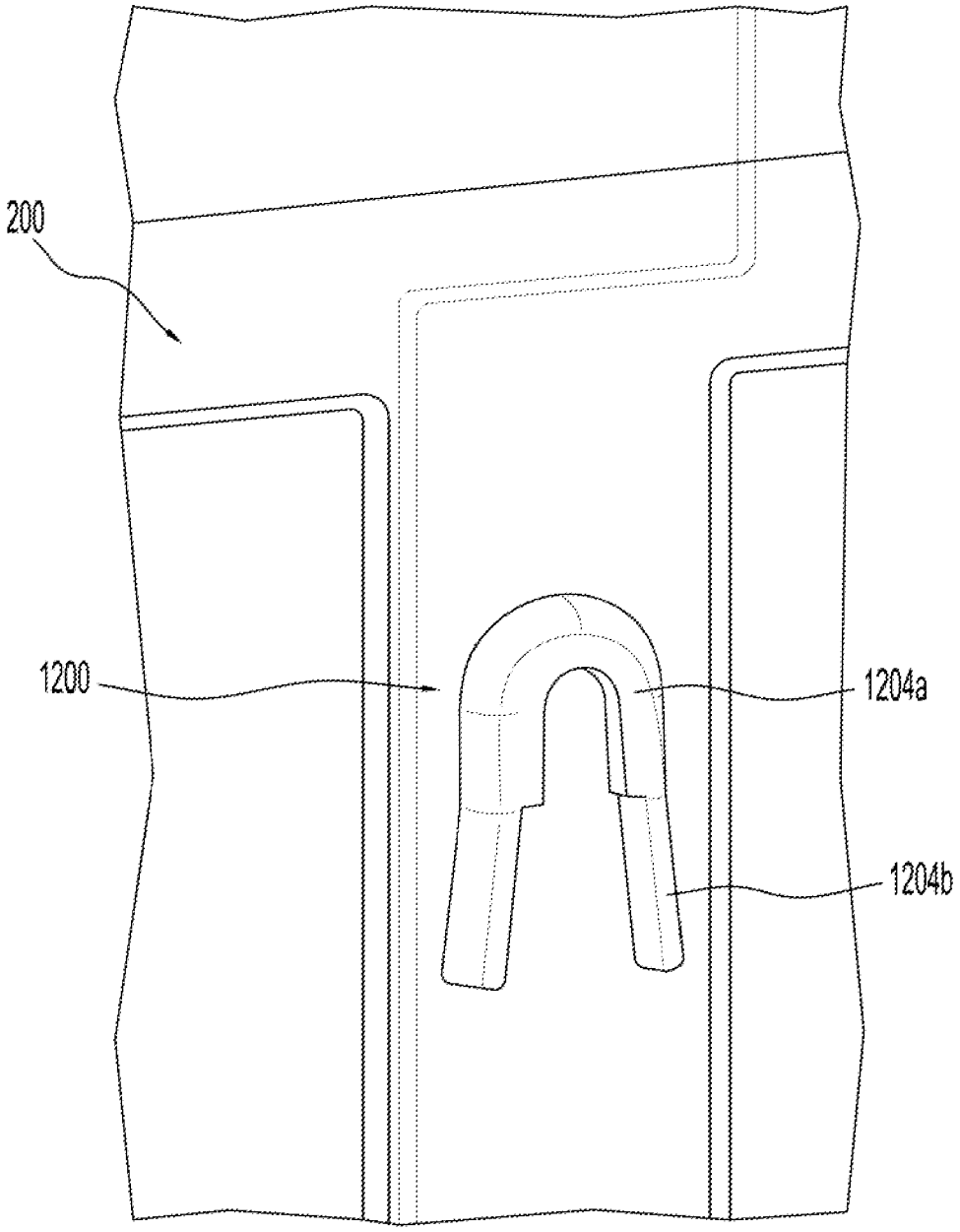
FIG. 12 depicts an example of a hook mechanism for a front loading can rack system according to some embodiments of the present disclosure.

FIG. 12 depicts an example of a hook mechanism 1200 for a front loading can rack system 200 according to some embodiments of the present disclosure. The hook mechanism 1200 can correspond to a first hook mechanism 304*a* depicted in FIG. 3. The hook mechanism 1200 can be positioned on a back wall of the front loading can rack system 200. The hook mechanism 1200 can be fastened around a bolt of the refrigeration appliance to hold the front loading can rack system 200 in a position within the refrigeration appliance. For example, a door or an ice maker of the refrigeration appliance can include a bolt onto which the first hook mechanisms 304*a* can be fastened. The hook mechanism 1200 can include a lower portion 1204*b*, which can be wider than an upper portion 1204*a*. The lower portion 1204*b* can be wider to facilitate easy coupling of the hook mechanism 1200 around a bolt. The upper portion 1204*a* can then be sized to fit tightly around at least a portion of the bolt.

Figure 13:
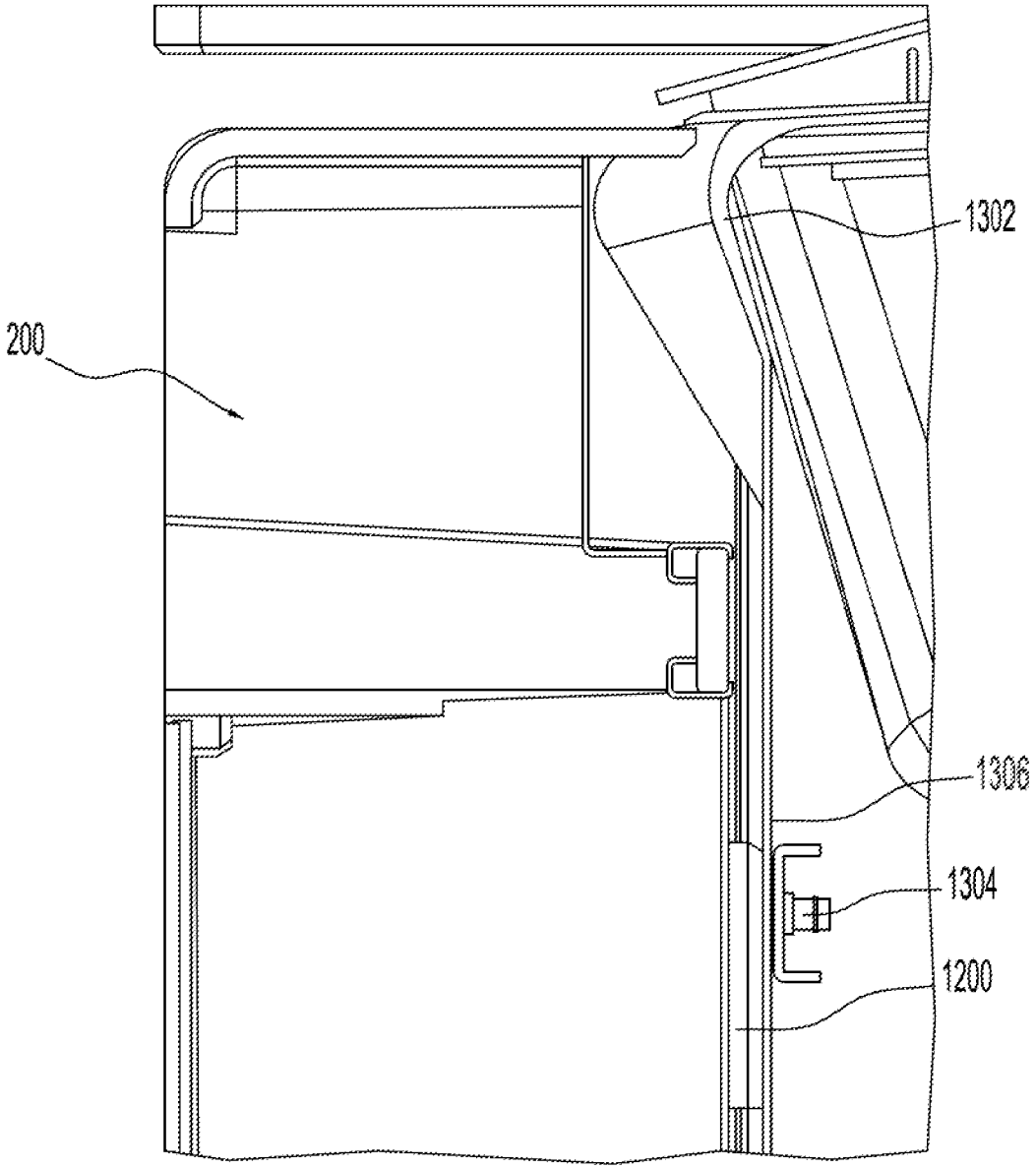
FIG. 13 depicts an example of a front loading can rack system and an ice maker according to some embodiments of the present disclosure.

FIG. 13 depicts an example of a front loading can rack system 200 and an ice maker 1302 according to some embodiments of the present disclosure. The front loading can rack system 200 can include one or more hook mechanisms, such as hook mechanism 1200. To position the front loading can rack system 200 within a refrigeration appliance, the hook mechanism 1200 can be attached to a bolt 134 on the ice maker 1302. In particular, the hook mechanism 1200 can at least partially encompass the bolt 1304. The bolt 1304 can be on an inner liner 1306 of the icemaker 1302. The front loading can rack system 200 can also include back and top cut outs that can be sized and positioned to enable the front loading can rack system 200 to slide on and off one or more bolts on a refrigeration door or the ice maker 302. Additionally, due to the top and back cut outs, the front loading can rack system 200 can be seamlessly integrated within the refrigeration appliance. For example, as depicted, the front loading can rack system 200 can be seamlessly integrated around the ice maker 1302 such that the ice maker 1302 may be at least partially disposed within the front loading can rack system 200.

Figure 14:
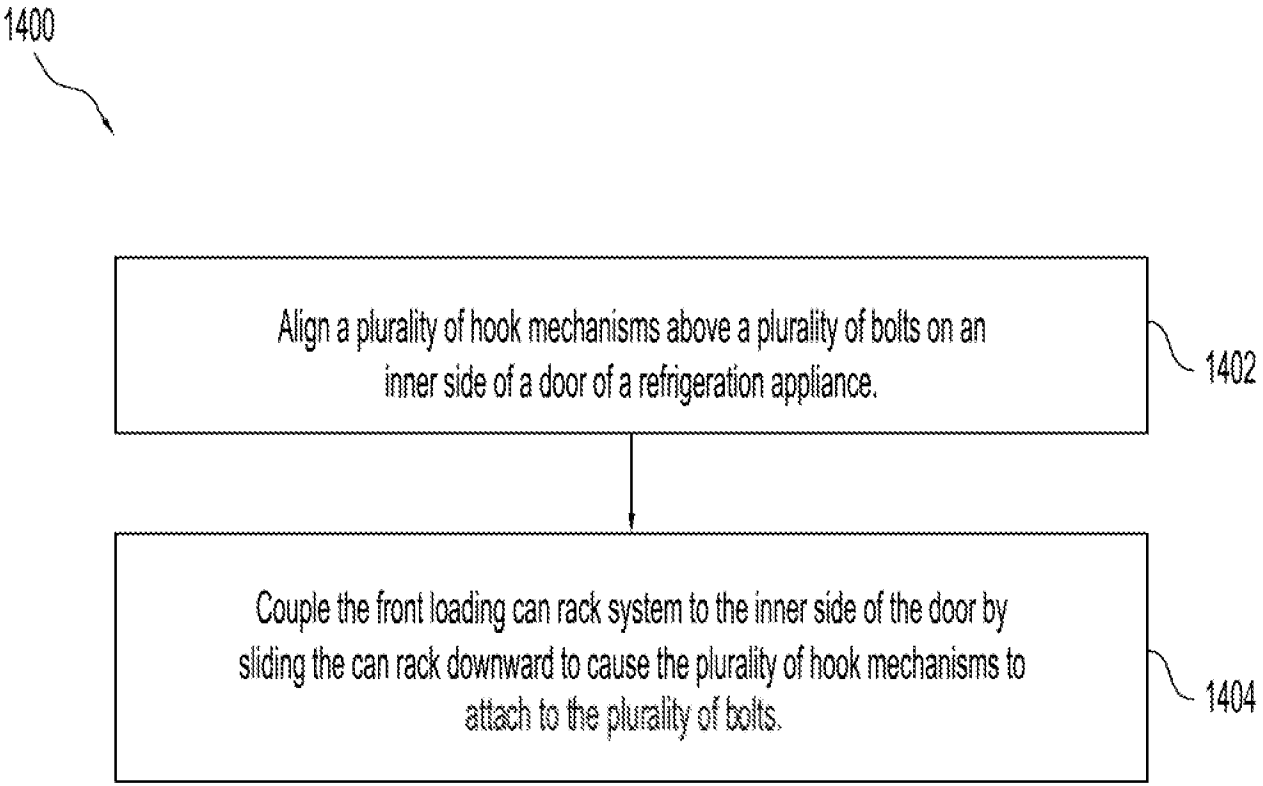
FIG. 14 is a flowchart of process for installing a front loading can rack system in a refrigeration appliance according to one example of the present disclosure.

FIG. 14 is a flowchart of a process 1400 for installing a front loading can rack system 200 in a refrigeration appliance according to one example of the present disclosure. While FIG. 14 depicts a certain sequence of steps for illustrative purposes, other examples can involve more steps, fewer steps, different steps, or a different order of the steps depicted in FIG. 14. The steps of FIG. 14 are described below with reference to the components of FIGS. 1-13 described above.

At block 1402, the process 1400 can involve positioning a front loading can rack system 200 on an inner side of a door of a refrigeration appliance 100 by aligning a plurality of hook mechanisms 304*a-d* above a plurality of bolts on the inner side of the door of the refrigeration appliance 100. The hook mechanisms 304*a-d* can be positioned on back walls 310*a-c* of compartments 201*a-b* of the front loading can rack system 200. The compartments 201*a-b* can be for receiving and storing cans within the front loading can rack system 200. The hook mechanisms 304*a-d* can include a lower portion 1204*b* and an upper portion 1204*a*. The lower portion 1204*b* can be wider than the upper portion 1204*a* to make it easier to align the hook mechanisms 304*a-d* with the bolts.

At block 1404, the process 1400 can involve positioning the front loading can rack system 200 on the inner side of the door of the refrigeration appliance by coupling the front loading can rack system 200 to the inner side of the door by sliding the front loading can rack system 200 downward to cause the plurality of hook mechanisms 304*a-d* to attach to the plurality of bolts. The front loading can rack system 200 can include a top cover 202. The front loading can rack system 200 can also include a first set of front openings 204*a-b* positioned directly below the top cover 202. Cans may be inserted into the compartments 201*a-b* via the first set of front openings 204*a-b*. Additionally, the front loading can rack system 200 can include a second set of front openings 204*c-d* positioned at bottoms of the compartments 201*a-b*. The cans may be dispensed from the front loading can rack system 200 via the second set of front openings 204*c-d*.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A front loading can rack system for a refrigeration appliance, the front loading can rack system comprising:

a top cover coupled with at least two walls of the front loading can rack system;

at least one compartment configured to store a plurality of cans;

a first set of front openings positioned at a top of the at least one compartment and directly below the top cover, the first set of front openings configured to receive each can of the plurality of cans such that each can of the plurality of cans is inserted via the first set of front openings into the at least one compartment;

a second set of front openings positioned at a bottom of the at least one compartment and configured to dispense each can of the plurality of cans;

a plurality of hook mechanisms positioned on one or more back walls of the at least one compartment, each hook mechanism of the plurality of hook mechanisms configured to couple the front loading can rack system to the refrigeration appliance by attaching to each bolt of a plurality of bolts of the refrigeration appliance;

a bottom flap configured to hold the plurality of cans within the at least one compartment; and a bottom dampener comprising a tab that includes a tab neck and a tab end, the tab being insertable into a hole of the bottom flap to couple the bottom dampener to the bottom flap.

2. The front loading can rack system of claim 1, further comprising at least two front flaps and at least two bottom flaps, wherein the at least two bottom flaps include the bottom flap, and wherein the at least two front flaps and at least two bottom flaps are configured to hold the plurality of cans within the at least one compartment.

3. The front loading can rack system of claim 2, wherein at least two bottom dampeners are coupled to the at least two bottom flaps, wherein the at least two bottom dampeners include the bottom dampener, wherein the at least two bottom dampeners comprise a plurality of tabs that include a plurality of tab neck and a plurality of tab ends, and wherein each tab of the plurality of tabs are inserted into holes of each bottom flap of the at least two bottom flaps to couple the at least two bottom dampeners to the at least two bottom flaps.

4. The front loading can rack system of claim 1, further comprising a top cutout and a back cutout, wherein the top cutout and the back cutout are configured to fit around an ice maker on an inner side of a door of the refrigeration appliance, and wherein the plurality of bolts is located on an inner liner of the ice maker.

5. The front loading can rack system of claim 1, further comprising a plurality of slots in the one or more back walls, wherein a plurality of back bumpers are coupled to the front loading can rack system via the plurality of slots, wherein each back bumper of the plurality of back bumpers comprises a flange that is inserted through a slot of the plurality of slots, and wherein each back bumper of the plurality of back bumpers further comprises a first flap that flexes downward while in contact with a first can of the plurality of cans as the first can descends through the at least one compartment to the bottom of the at least one compartment or on to a second can of the plurality of cans.

6. The front loading can rack system of claim 1, wherein each hook mechanism of the plurality of hook mechanisms comprises an upper portion and lower poriton, and wherein the lower portion is wider than the upper portion.

7. The front loading can rack system of claim 1, wherein the top cover is a textured top cover.

8. A method comprising:

positioning a front loading can rack system on an inner side of a door of a refrigeration appliance by:

aligning a plurality of hook mechanisms above a plurality of bolts on the inner side of the door of the refrigeration appliance, the plurality of hook mechanisms positioned on one or more back walls of at least one compartment of the front loading can rack system, and the at least one compartment configured to store a plurality of cans; and coupling the front loading can rack system to the inner side of the door by sliding the can rack downward to cause the plurality of hook mechanisms to attach to the plurality of bolts, the front loading can rack system comprising a top cover, a first set of front openings positioned directly below the top cover and configured to receive a plurality of cans such that each can of the plurality of cans is inserted via the first set of front openings into the at least one compartment, a second set of front openings positioned at a bottom of the at least one compartment and configured to dispense each can of the plurality of cans, a bottom flap configured to hold the plurality of cans within the at least one compartment, and a bottom dampener comprising a tab that includes a tab neck and a tab end, the tab being insertable into a hole of the bottom flap to couple the bottom dampener to the bottom flap.

9. The method of claim 8, wherein the front loading can rack system further comprises at least two front flaps and at least two bottom flaps, wherein the at least two bottom flaps include the bottom flap, and wherein the at least two front flaps and at least two bottom flaps are configured to hold the plurality of cans within the at least one compartment.

10. The method of claim 9, further comprising coupling at least two bottom dampeners to the at least two bottom flaps, wherein the at least two bottom dampeners include the bottom dampener, wherein the at least two bottom dampeners comprise a plurality of tabs that include a plurality of tab necks and a plurality of tab ends, and wherein coupling the at least two bottom dampeners to the at least two bottom flaps comprises inserting, for each bottom dampener of the at least two bottom dampeners, each tab of the plurality of tabs into holes of each bottom flap of the at least two bottom flaps.

11. The method of claim 8, wherein the front loading can rack system further comprises a top cutout and a back cutout configured to fit around an ice maker on the inner side of the door of the refrigeration appliance, and wherein the plurality of bolts is located on an inner liner of the ice maker.

12. The method of claim 8, wherein the front loading can rack system further comprises a plurality of slots in the one or more back walls, wherein the method further comprising coupling a plurality of back bumpers to the front loading can rack system via the plurality of slots, wherein each back bumper of the plurality of back bumpers comprises a flange, wherein coupling the plurality of back bumpers to the front loading can rack system comprises inserting the flange of each back bumper of the plurality of back bumpers through each slot of the plurality of slots, and wherein each back bumper of the plurality of back bumpers further comprises a first flap that flexes downward while in contact with a first can of the plurality of cans as the first can descends through the at least one compartment to the bottom of the at least one compartment or on to a second can of the plurality of cans.

13. The method of claim 9, wherein each hook mechanism of the plurality of hook mechanisms comprise an upper portion and a lower portion, wherein aligning the plurality of hook mechanisms above the plurality of bolts on the inner side of the door of the refrigeration appliance comprises aligning the lower portions of the plurality of hook mechanisms with the bolts, and wherein coupling the front loading can rack system to the inner side of the door by sliding the can rack downward to cause the plurality of hook mechanisms to attach to the plurality of bolts comprises coupling the upper portions of the plurality of hook mechanisms around at least a portion of the bolts.

14. The method of claim 8, wherein the top cover is a textured top cover.

15. A refrigeration appliance comprising:

a front loading can rack system, the front loading can rack system comprising:

a top cover coupled with at least two walls of the front loading can rack system;

at least one compartment configured to store a plurality of cans;

a first set of front openings positioned at a top of the at least one compartment and directly below the top cover, the first set of front openings configured to receive each can of the plurality of the plurality of cans such that each can of the plurality of cans is inserted via the first set of front openings into the at least one compartment;

a second set of front openings positioned at a bottom of the at least one compartment and configured to dispense each can of the plurality of cans; and a plurality of hook mechanisms positioned on one or more back walls of the at least one compartment, each hook mechanism of the plurality of hook mechanisms configured to couple the front loading can rack system to the refrigeration appliance by attaching to each bolt of a plurality of bolts of the refrigeration appliance a bottom flap configured to hold the plurality of cans within the at least one compartment; and a bottom dampener comprising a tab that includes a tab neck and a tab end, the tab being insertable into a hole of the bottom flap to couple the bottom dampener to the bottom flap.

16. The refrigeration appliance of claim 15, wherein the front loading can rack system further comprises at least two front flaps and at least two bottom flaps, wherein the at least two bottom flaps include the bottom flap, and wherein the at least two front flaps and the at least two bottom flaps are configured to hold the plurality of cans within the at least one compartment.

17. The refrigeration appliance of claim 16, further comprising at least two bottom dampeners that are coupled to the at least two bottom flaps, wherein the at least two bottom dampeners include the bottom dampener, wherein the at least two bottom dampeners comprises a plurality of tabs that include a plurality of tab necks and a plurality of tab ends, and wherein each tab of the plurality of tabs, for each bottom dampener of the at least two bottom dampeners, are inserted into holes of each bottom flap of the at least two bottom flaps to couple the at least two bottom dampeners to the at least two bottom flaps.

18. The refrigeration appliance of claim 15, further comprising an ice maker on an inner side of a door of the refrigeration appliance, wherein the front loading can rack system further comprises a top cutout and a back cutout configured to fit around the ice maker, and wherein the plurality of bolts is located on an inner liner of the ice maker.

19. The refrigeration appliance of claim 15, wherein the front loading can rack system further comprises a plurality of slots in the one or more back walls, wherein a plurality of back bumpers are coupled to the front loading can rack system via the plurality of slots, wherein each back bumper of the plurality of back bumpers comprises a flange that is inserted through a slot of the plurality of slots, and wherein each back bumper of the plurality of back bumpers further comprises a first flap that flexes downward while in contact with a first can of the plurality of cans as the first can descends through the at least one compartment to the bottom of the at least one compartment or on to a second can of the plurality of cans.

20. The refrigeration appliance of claim 15, wherein each of the plurality of hook mechanisms comprise an upper portion and lower portion, and wherein the lower portion is wider than the upper portion.

* * * * *